US008002138B2

(12) United States Patent
Fitzgerald et al.

(10) Patent No.: US 8,002,138 B2
(45) Date of Patent: Aug. 23, 2011

(54) ITEM RECEIVING SYSTEMS AND METHODS

(75) Inventors: Robert M. Fitzgerald, Norcross, GA (US); Kyle A. Joiner, Roswell, GA (US); Joel H. Eisler, Lawrenceville, GA (US); James W. Dotson, Sr., Cumming, GA (US)

(73) Assignee: Innovative Product Achievements, Inc., Duluth, GA (US)

( * ) Notice: Subject to any disclaimer, the term of this patent is extended or adjusted under 35 U.S.C. 154(b) by 1238 days.

(21) Appl. No.: 11/393,445

(22) Filed: Mar. 29, 2006

(65) Prior Publication Data

US 2007/0246470 A1 Oct. 25, 2007

(51) Int. Cl.
*B65D 25/04* (2006.01)

(52) U.S. Cl. ..... 220/529; 220/532; 220/544; 220/551

(58) Field of Classification Search ..... 220/532, 220/551, 544, 549, 534, 908, 523, 529, 530, 220/531

See application file for complete search history.

(56) References Cited

U.S. PATENT DOCUMENTS

| | | | | | |
|---|---|---|---|---|---|
| 2,478,815 | A | | 8/1949 | Forman | |
| 2,653,693 | A | | 9/1953 | Dosberg | |
| 2,895,782 | A | * | 7/1959 | Fragale | 312/290 |
| 3,285,505 | A | * | 11/1966 | Katz | 232/43.3 |
| 3,696,737 | A | | 10/1972 | Wikner | |
| 4,301,942 | A | * | 11/1981 | Kupperman et al. | 220/592.17 |
| 4,420,083 | A | * | 12/1983 | Baustin | 206/538 |
| 4,519,308 | A | | 5/1985 | Eberle | |
| 4,552,061 | A | | 11/1985 | Brutsman | |
| 4,896,593 | A | | 1/1990 | Slusser | |
| 4,944,419 | A | * | 7/1990 | Chandler | 220/502 |
| 5,005,727 | A | * | 4/1991 | Roth | 220/495.09 |
| 5,042,374 | A | * | 8/1991 | Klepacki | 100/229 A |
| 5,082,139 | A | * | 1/1992 | Quam | 220/530 |
| 5,090,785 | A | * | 2/1992 | Stamp | 312/319.9 |
| 5,103,998 | A | * | 4/1992 | Caro et al. | 220/533 |
| 5,303,841 | A | * | 4/1994 | Mezey | 220/555 |
| 5,484,078 | A | * | 1/1996 | Bronovicki | 220/531 |
| 5,713,270 | A | | 2/1998 | Fitzgerald et al. | |
| 5,829,349 | A | | 11/1998 | Fitzgerald et al. | |
| 5,833,336 | A | * | 11/1998 | Dean | 312/293.2 |
| 5,884,556 | A | * | 3/1999 | Klepacki et al. | 100/349 |
| 6,223,934 | B1 | | 5/2001 | Shoenfeld | |
| 6,231,099 | B1 | * | 5/2001 | Greenwald | 296/37.8 |
| 6,330,856 | B1 | | 12/2001 | Fitzgerald et al. | |
| 6,382,377 | B2 | * | 5/2002 | Godshaw | 190/110 |
| 6,386,386 | B1 | * | 5/2002 | George | 220/526 |

(Continued)

*Primary Examiner* — Anthony Stashick
*Assistant Examiner* — Christopher McKinley
(74) *Attorney, Agent, or Firm* — Alston & Bird LLP

(57) ABSTRACT

An item receiving apparatus that, in various embodiments, comprises: (1) a housing defining an interior storage area and an opening through which at least one item may be received for storage within the interior storage area; (2) an item support surface disposed adjacent the interior storage area for supporting one or more items as the items are stored within the interior storage area; (3) an item repositioning assembly disposed between the opening and the item support surface. The item receiving apparatus may be adapted to move the item repositioning assembly from a first orientation to a second orientation in response to the occurrence of a pre-determined event. The item repositioning assembly may be adapted to push one or more items within the storage area laterally away from at least a portion of the item repositioning assembly as the item repositioning assembly is moved from the first orientation to the second orientation.

42 Claims, 7 Drawing Sheets

U.S. PATENT DOCUMENTS 6,439,500 B1 8/2002 Shoenfeld
6,913,386 B2 * 7/2005 Maher et al. ..... 383/38
6,966,450 B2 * 11/2005 Askew ..... 220/529
7,083,064 B2 * 8/2006 Zorzo ..... 220/529
7,290,674 B1 * 11/2007 Ledford ..... 220/507
2002/0096525 A1 * 7/2002 Bertoldo et al. ..... 220/544
2007/0187912 A1 * 8/2007 Taulman et al. ..... 280/47.26
2007/0200471 A1 * 8/2007 Boone ..... 312/211

* cited by examiner

Section A-A

Section A-A

ITEM RECEIVING SYSTEMS AND METHODS

BACKGROUND OF THE INVENTION

In the past, secure cabinets have been used to receive items (such as dirty hospital linens) for storage and later retrieval by appropriate personnel (e.g., laundry personnel). One problem with such cabinets (which are often called "receivers") is that the storage capacity of these cabinets is limited. Accordingly, there is a need for new mechanisms and methods for increasing the storage capacity of receivers, such as receivers for linen items.

SUMMARY OF THE INVENTION

An item receiving apparatus according to various embodiments of the invention comprises: (1) a housing defining an interior storage area and an opening through which at least one item may be received for storage within the interior storage area; (2) an item support surface disposed adjacent the interior storage area for supporting one or more items as the items are stored within the interior storage area; and (3) an item repositioning assembly disposed between the opening and the item support surface. In particular embodiments: (A) the item receiving apparatus is adapted to move the item repositioning assembly from a first orientation to a second orientation in response to the occurrence of a pre-determined event, and (B) the item repositioning assembly is adapted to push one or more items within the storage area laterally away from at least a portion of the item repositioning assembly as the item repositioning assembly is moved from the first orientation to the second orientation.

An item receiving apparatus according to particular embodiments of the invention comprises: (1) a housing defining: (a) an interior storage area, and (b) an opening through which at least one item may be received for storage within the interior storage area; (2) an item support surface disposed adjacent the interior storage area for supporting one or more items as the items are stored within the interior storage area; and (3) an item repositioning assembly disposed between the opening and the item support surface, wherein the item receiving apparatus is adapted to move the item repositioning assembly from a first orientation to a second orientation. In particular embodiments, as the item repositioning assembly moves from the first orientation to the second orientation, the item repositioning assembly expands laterally to reposition one or more items stored within the interior storage area.

An item receiving apparatus according to further embodiments of the invention comprises: (1) a housing defining: (a) an interior storage area, and (b) an opening through which at least one item may be received for storage within the interior storage area; (2) an item support surface disposed adjacent the interior storage area for supporting one or more items as the items are stored within the interior storage area; and (3) an item repositioning assembly disposed between the opening and the item support surface, wherein the apparatus is adapted to move the item repositioning assembly from a first orientation to a second orientation. In particular embodiments, as the item repositioning assembly moves from the first orientation to the second orientation, the item repositioning assembly expands laterally to at least partially obstruct a path between the opening and the item support surface.

BRIEF DESCRIPTION OF THE DRAWINGS

Figure 1:
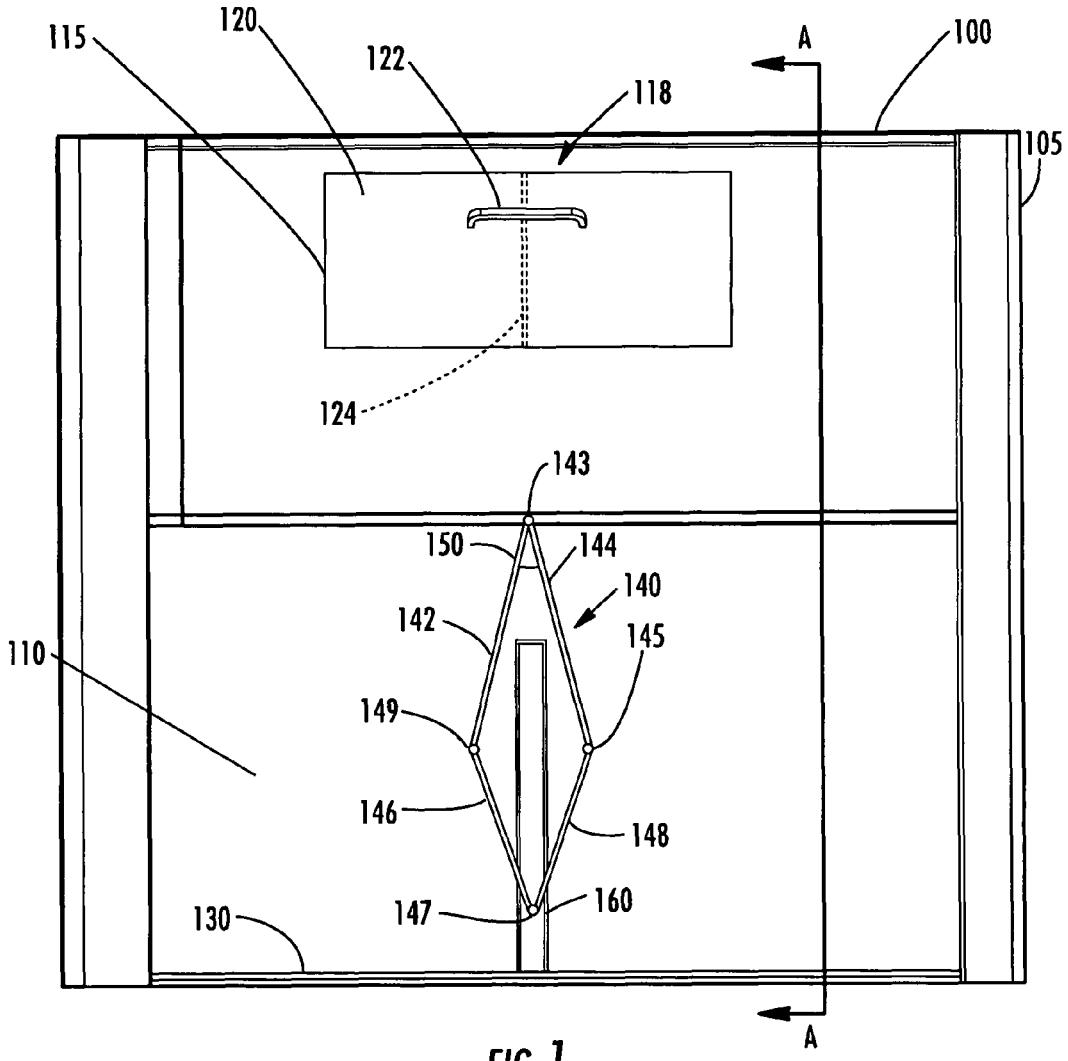

Having thus described the invention in general terms, reference will now be made to the accompanying drawings, which are not necessarily drawn to scale, and wherein:

FIG. 1 is a front view of an item receiving apparatus according to a particular embodiment of the invention in which the lower front portion of the item receiving apparatus' cabinet has been removed to show an item repositioning assembly according to a particular embodiment of the invention that is disposed within the interior of the item receiving apparatus. In this figure, the item repositioning assembly is shown in a "home" orientation.

Figure 2:
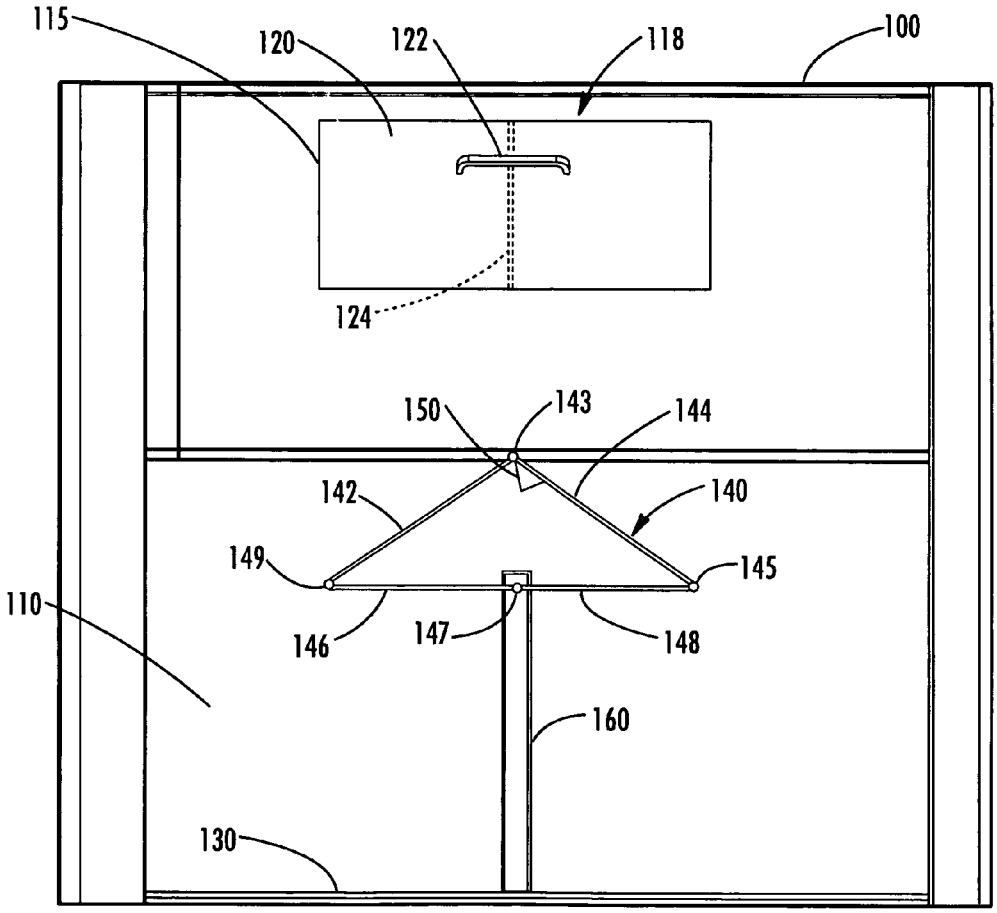

FIG. 2 is a front view of the item receiving apparatus of FIG. 1, in which the item repositioning assembly is shown in an item redistribution orientation.

Figure 3:
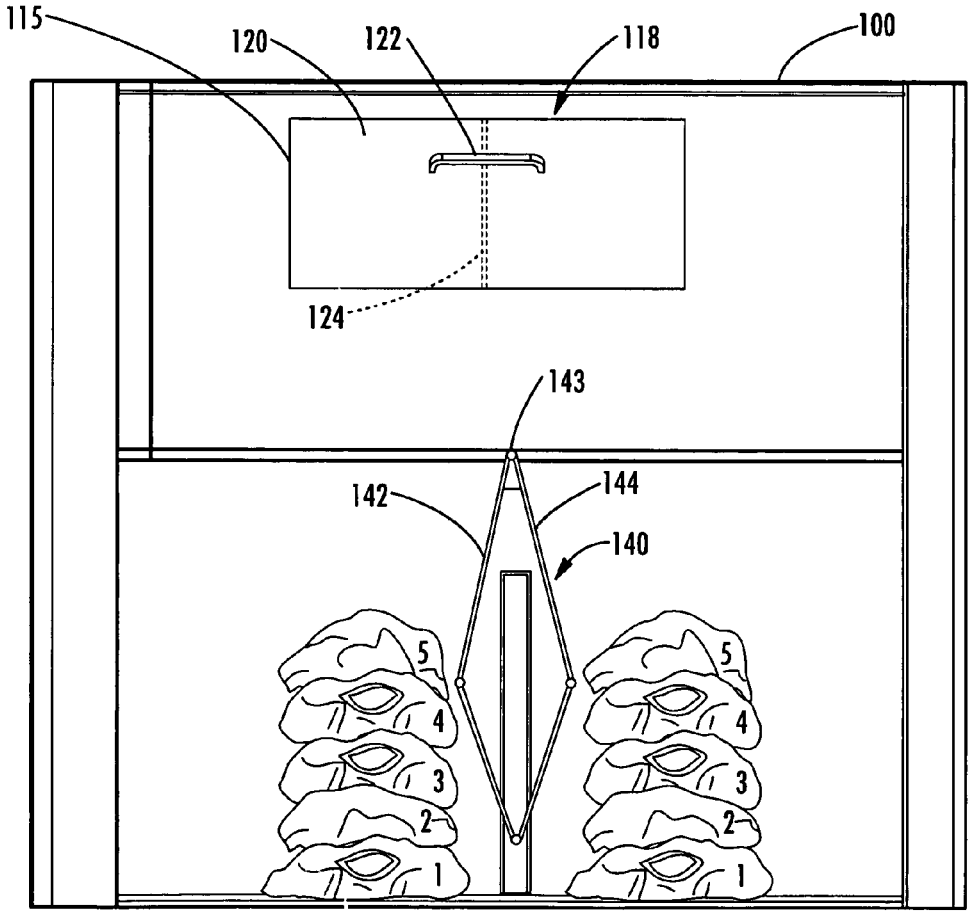

FIG. 3 is a front view of the item receiving apparatus of FIG. 1, in which the item repositioning assembly is shown in a home orientation, and is disposed between two piles of linen items.

Figure 4:
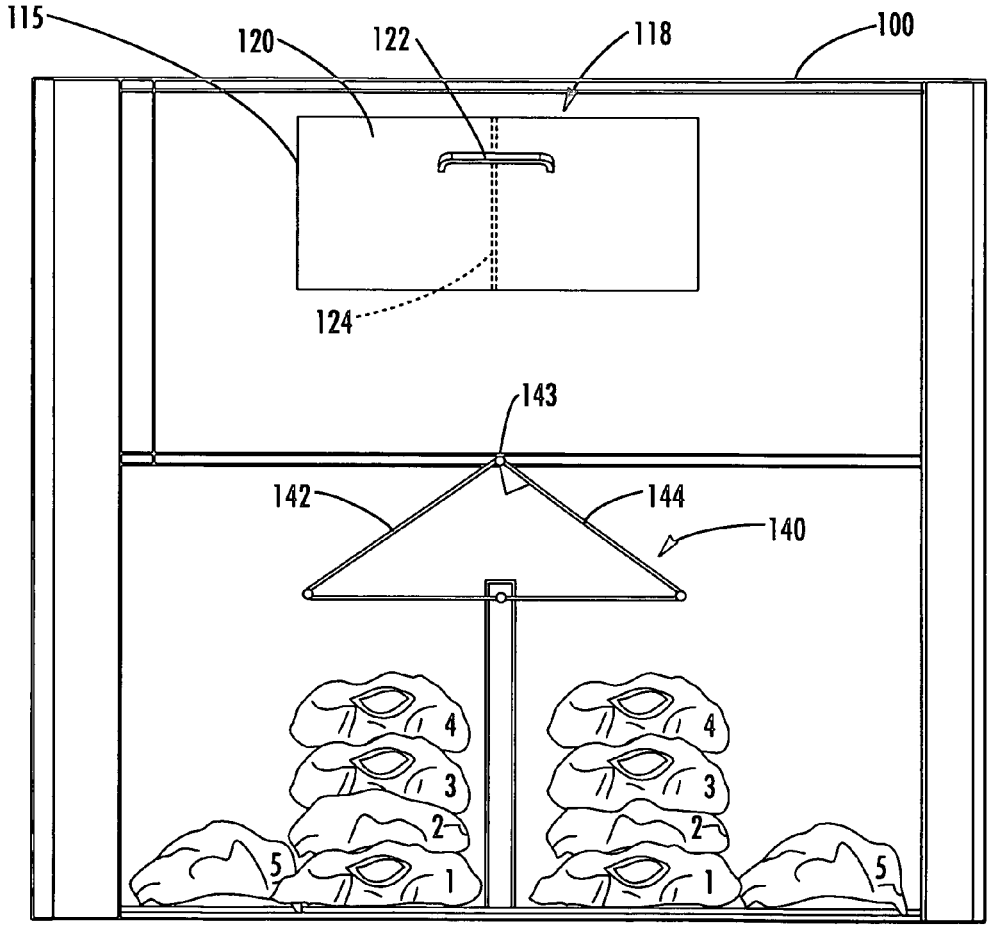

FIG. 4 is a front view of the item receiving apparatus of FIG. 1, in which the item repositioning assembly is shown in an item redistribution orientation, and is disposed between two piles of linen items after having redistributed the uppermost linen item from each of the two piles of linen items.

Figure 5A:
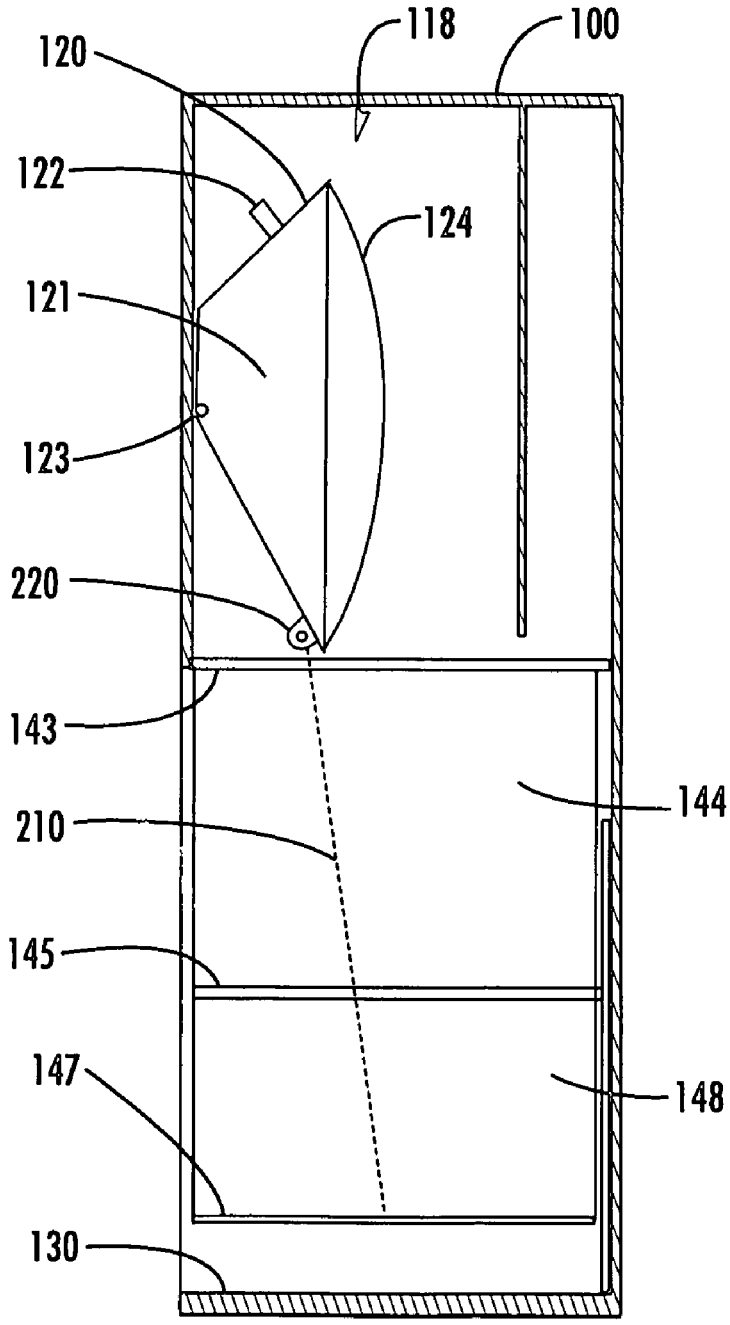

FIG. 5A is a side view of one embodiment of the item receiving apparatus of FIG. 1 taken through Section A-A in FIG. 1. In this figure, the item receiving apparatus's door assembly is shown in a closed position, and the item repositioning assembly is shown in a "home" orientation.

Figure 5B:
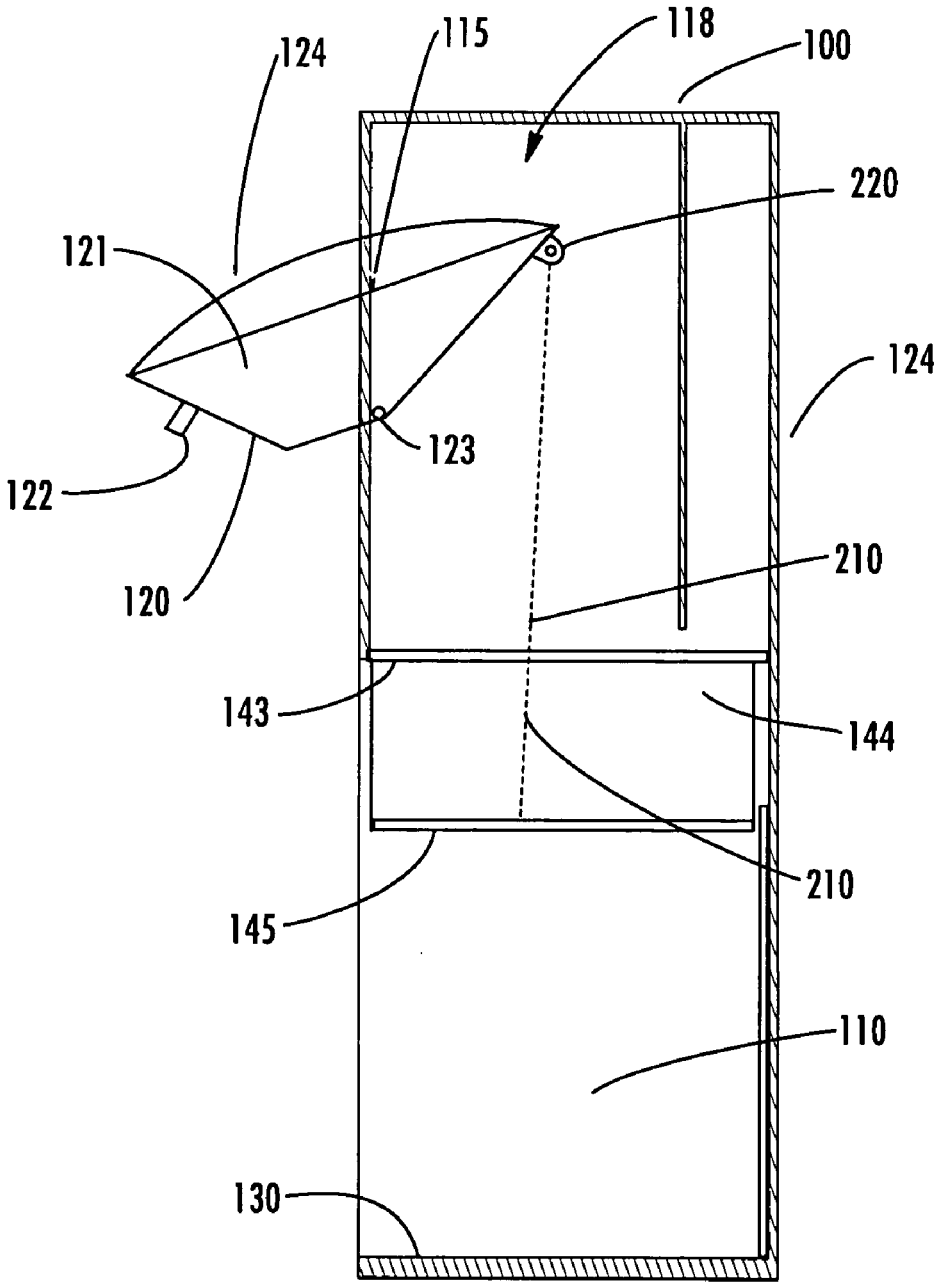

FIG. 5B is a side view of the item receiving apparatus of FIG. 5A. In this figure, the item receiving apparatus's door assembly is shown in an open position, and the item repositioning assembly is shown in an "item redistribution" orientation.

Figure 6B:
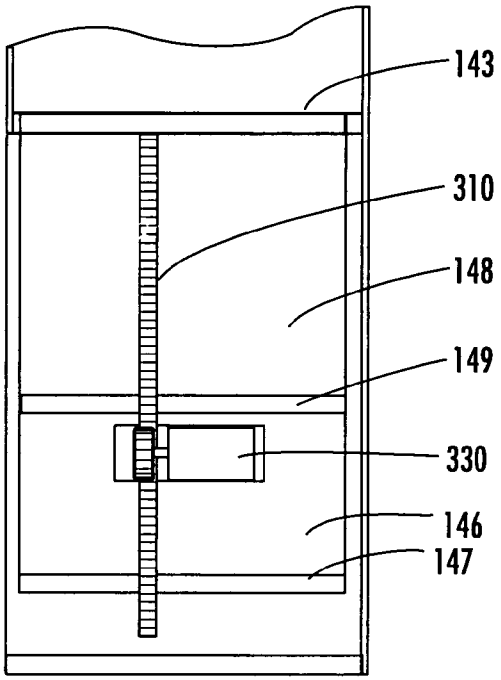
Figure 6A:
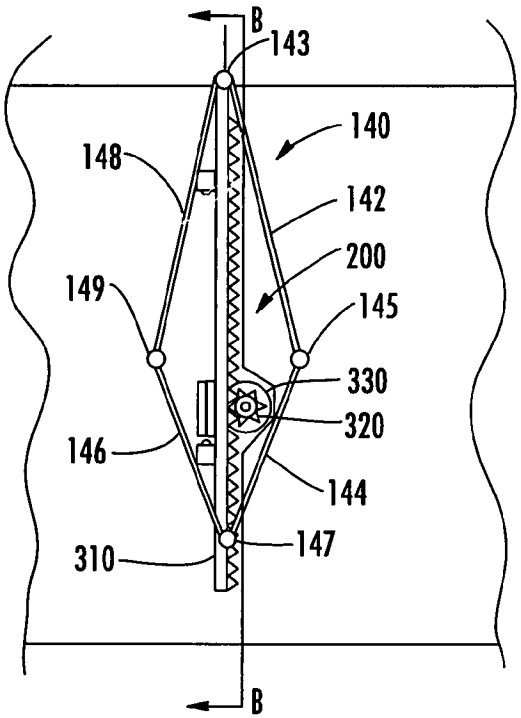

FIG. 6A is front view of an item repositioning assembly and an item repositioning assembly actuation mechanism (an "actuation mechanism") according to a particular embodiment of the invention.

FIG. 6B is a side view of the item repositioning assembly and item repositioning assembly actuation mechanism of FIG. 6A.

DETAILED DESCRIPTION OF VARIOUS EMBODIMENTS OF THE INVENTION

The present invention now will be described more fully with reference to the accompanying drawings, in which some, but not all embodiments of the invention are shown. Indeed, this invention may be embodied in many different forms and should not be construed as limited to the embodiments set forth herein. Rather, these embodiments are provided so that this disclosure will satisfy applicable legal requirements. Like numbers refer to like elements throughout.

A. Structure of an Exemplary Item Receiving Apparatus

Housing Structure

An item receiving apparatus 100 according to various embodiments of the invention is shown in FIGS. 1-5. As noted above, in these figures, the lower front portion of the item receiving apparatus' housing 105 has been removed to show an item repositioning assembly 140 that is disposed within an interior portion of the item receiving apparatus 100.

As may be understood from FIG. 1, in various embodiments, the item receiving apparatus 100 includes a housing 105, which may be, for example, a cabinet that is in the form of an upright rectangular metal box. In certain embodiments, the housing 105 is preferably substantially hollow, and defines an item support surface 130, an interior storage area 110 that is adjacent (e.g., immediately above) the item support surface 130, and an item receiving opening 115 through which items can be conveyed into the interior portion of the item receiving apparatus 100. In various embodiments, a hinged item deposit door 120 is disposed adjacent the item receiving opening 115 and is adapted to be moved (e.g., rotated) between: (1) a closed position, in which the item deposit door 120 restricts (and preferably prevents) access to the interior portion of the item receiving apparatus 100; and (2) an open position, in which the item deposit door 120 does not restrict (e.g., prevent) access to the item receiving apparatus's interior portion.

In various embodiments, the item deposit door 120 is part of a door assembly 118 that includes an item receiving bucket 121 (See FIGS. 5A and 5B). In particular embodiments, this item receiving bucket 121 is disposed adjacent an interior surface of the deposit door 120. As shown in FIGS. 5A and 5B, in various embodiments, the door assembly 118 is preferably rotatably mounted (e.g., via a hinge 123) adjacent the item receiving opening 115. In various embodiments, this allows a user to rotate the door assembly 118 from a closed position (see FIG. 5A) to an open position (see FIG. 5B). The user may then place one or more items into the item receiving bucket 121, which holds the items in place adjacent the interior of the item deposit door 120 while the door assembly 118 is in an open position. In various embodiments, the door assembly 118 is further configured to allow the user to then rotate the door assembly 118 from the open position to a closed position. In particular embodiments, the item receiving bucket 121 is dimensioned to allow items to slide from the item receiving bucket 121 and into the item receiving apparatus' interior storage area 110 as the door assembly 118 is moved from an open position to a closed position.

In certain embodiments, the door assembly 118 includes a separator 124, which may, for example, be a substantially planer, substantially vertical member that is adapted to separate an interior portion of the door assembly's item receiving bucket 121 into two physically separate item receiving portions (e.g., a first item receiving portion and a second item receiving portion) that are laterally adjacent each other. In various embodiments, the separator 124 is disposed between the item receiving bucket's first and second item receiving portions. In particular embodiments, for reasons described in greater detail below, the separator 124 is adapted to prevent users from placing items into a middle interior portion of the item receiving bucket 121.

Returning to the general structure of the item receiving apparatus 100, in particular embodiments of the invention, the item receiving opening 115 is defined within an upper portion of a side surface (e.g., a front side surface) of the item receiving apparatus' housing 105, and the interior storage area 110 and the item support surface 130 are defined adjacent a lower portion of the item receiving apparatus 100. As a result, in various embodiments, the item receiving opening 115 is positioned above both the interior storage area 110 and the item support surface 130.

Also, in particular embodiments, the item receiving opening 115 is substantially laterally aligned with at least a portion of: (1) interior storage area 110; and/or (2) the item support surface 130. As a result, in certain embodiments, items inserted through the item receiving opening 115 fall into the interior storage area 110, where they are supported (either directly or indirectly) by the item support surface 130.

Structure of Item Repositioning Assembly

In various embodiments, the item receiving apparatus 100 further includes an item repositioning assembly 140 that is adapted to push items disposed within the item receiving apparatus' interior storage area 110 laterally toward the item receiving apparatus' lateral sides (and, preferably, laterally away from at least a portion of the item repositioning assembly 140). In addition, the item repositioning assembly 140 may optionally be adapted to divert items as the items fall from the item receiving opening 115 into the interior storage area 110. As shown in FIG. 1, in particular embodiments, the item repositioning assembly 140 includes: (1) a first item repositioning member 142 having an upper side edge and a lower side edge; (2) a second item repositioning member 144 having an upper side edge and a lower side edge; (3) a third item repositioning member 146 having an upper side edge and a lower side edge; and (4) a fourth item repositioning member 148. (As used in regard to the side edges of the first, second, third, and fourth item repositioning members 142, 144, 146, 148, the terms "upper" and "lower" are defined in regard to the relative position of these side edges when the item repositioning assembly 140 is in a home orientation, such as the orientation shown in FIG. 1).

The first item repositioning member 142, second item repositioning member 144, third item repositioning member 146, and fourth item repositioning member 148 are preferably each substantially rectangular, substantially planar members. As a result, for example, the first and second item repositioning members 142, 144 may define substantially flat, substantially smooth outer surfaces (which, in various embodiments, face generally upwardly when the item repositioning assembly 140 is in an item redistribution orientation). Similarly, the third and fourth item repositioning members 146, 148 may define substantially flat, substantially smooth lower surfaces (which, in various embodiments, face generally downwardly when the item repositioning assembly 140 is in an item redistribution orientation). This serves to facilitate the smooth transition of items along the outer surfaces of the item repositioning assembly 140.

In particular embodiments of the invention, the first and second item repositioning members 142, 144 have substantially the same length and/or width. Similarly, in various embodiments of the invention, the third and fourth item repositioning members 146, 148 have substantially the same length and/or width. Also, in particular embodiments, the length of the first, second, third and fourth item repositioning members 142, 144, 146, 148 have substantially the same length and/or width.

In various embodiments, the upper side edge of the first item repositioning member 142 is rotatably connected adjacent (and preferably to) the upper side edge of the second item repositioning member 144 via a suitable rotatable connection device such as a hinge. For example, in the embodiment shown in FIG. 1, the upper side edge of the first item repositioning member 142 is rotatably connected to the upper side edge of the second item repositioning member 144 via a first hinge 143. Similarly, in particular embodiments, the lower side edge of the second item repositioning member 144 is rotatably connected adjacent (and preferably to) the upper side edge of the fourth item repositioning member 148 via a suitable rotatable connection device. For example, in the embodiment shown in FIG. 1, the lower side edge of the second item repositioning member 144 is rotatably connected to the upper side edge of the fourth item repositioning member 148 via a second hinge 145.

In addition, in particular embodiments, the lower side edge of the fourth item repositioning member 148 is rotatably connected adjacent (and preferably to) the lower side edge of the third item repositioning member 146 via a suitable rotatable connection device. For example, in the embodiment shown in FIG. 1, the lower side edge of the fourth item repositioning member 148 is rotatably connected to the lower side edge of the third item repositioning member 146 via a third hinge 147. Similarly, in particular embodiments, the lower side edge of the first item repositioning member 142 is rotatably connected adjacent (and preferably to) the upper side edge of the third item repositioning member 146 via a suitable rotatable connection device. For example, in the embodiment shown in FIG. 1, the lower side edge of the first item repositioning member 142 is rotatably connected to the upper side edge of the third item repositioning member 146 via a fourth hinge 149.

In particular embodiments of the invention, the item repositioning assembly 140 is supported within the item receiving apparatus 100 by an elongate support rod that extends through (or adjacent) the item repositioning assembly's first hinge 143. This rod is preferably: (1) mounted, at a first end, immediately adjacent (and preferably to) the interior portion of the item receiving apparatus' front side wall; and (2) mounted, at a second end, immediately adjacent (and preferably to) the interior portion of the item receiving apparatus' rear side wall. This may allow the first item repositioning member 142, second item repositioning member 144, third item repositioning member 146, and fourth item repositioning member 148 to rotate substantially freely about the hinges 143, 145, 147, 148 to which they are attached.

In various embodiments, as a result of the above structural arrangement, the overall arrangement of the first item repositioning member 142, second item repositioning member 144, third item repositioning member 146, and fourth item repositioning member 148 may be changed by simply changing the vertical height of the third hinge 147. For example, the item repositioning assembly 140 may be moved from the first, "home" orientation shown in FIG. 1 to the second, "item redistribution" orientation shown in FIG. 2 by simply moving the third hinge 147 upwardly along a substantially vertical axis.

As may be understood from FIGS. 1 and 2, when the item repositioning assembly 140 is in a first, "home" orientation (see FIG. 1), the first item repositioning member 142, second item repositioning member 144, third item repositioning member 146, and fourth item repositioning member 148 cooperate to form a structure having a substantially diamond-shaped cross-section. In various embodiments, the interior sides of the first and second item repositioning members 142, 144 are prevented from coming into contact with each other by a stop block 150 that is disposed adjacent an upper interior side of either the first item repositioning member 142 or the second item repositioning member 144. For example, in the embodiment shown in FIGS. 1 and 2, the item repositioning assembly 140 includes a substantially triangularly shaped stop block 150. In various embodiments, this stop block 150 is adapted and positioned to prevent the first and second item repositioning members 142, 144 from moving into an orientation in which the interior angle formed by the first and second item repositioning members is less than a pre-determined value (e.g., 5, 10, 15, or 20 degrees).

It should be understood that various other devices or configurations may be used to prevent the interior sides of the first and second item repositioning members 142, 144 from coming into contact with each other. For example, a rod may extend through the third hinge 147 and into a guide slot (e.g., a substantially vertical guide slot) that may be disposed, for example, adjacent the inter rear wall of the housing 105. In various embodiments, this guide slot may be dimensioned to limit the downward motion of the rod (and, accordingly, the third hinge 147). This may serve to prevent the first and second item repositioning members 142, 144 from coming into contact with each other.

In a further embodiment of the invention in which the vertical motion of the third hinge is controlled by a connecting member, such as a cable (e.g., a cable attached to the dispenser's item deposit door 120), the length of the connecting member may be selected to limit the downward motion of the third hinge 147 and to thereby prevent the first and second item repositioning members 142, 144 from coming into contact with each other.

Location of the Item Repositioning Assembly

In various embodiments of the invention, the item repositioning assembly 140 is mounted: (1) so that the vertical position of the item repositioning assembly's first hinge 143 is lower than the vertical position of the item positioning assembly's item receiving opening 115; and (2) so that the item repositioning assembly's first hinge 143 is substantially centered between the lateral side edges of the item receiving opening 115. In further embodiments of the invention, the item repositioning assembly 140 is positioned: (1) so that the vertical position of the item repositioning assembly's first hinge 143 is lower than the vertical position of the item repositioning assembly's item receiving opening 115; and (2) so that the item repositioning assembly's first hinge 143 is substantially in lateral alignment with at least a portion of the door assembly's separator 124.

In particular embodiments, the door assembly's separator 124 is substantially planar and the item repositioning assembly's first and/or third hinges 143, 147 are positioned so that they are disposed within or immediately adjacent a plane that is coplanar with the door assembly's separator 124 when: (1) the item repositioning assembly 140 is in the first, "home" orientation described above; and/or (2) the item repositioning assembly 140 is in the second, "item redistribution" orientation described above. In particular embodiments, as a result of this configuration, the separator 124 serves to prevent items from falling directly onto the item repositioning assembly's first hinge 143, which may prevent items from coming to rest on the first hinge 143 rather than moving further into the interior storage area 110.

In various embodiments of the invention, the item repositioning assembly 140 is positioned so that the item repositioning assembly 140 is substantially laterally centered between: (1) the sides of the item receiving apparatus' item receiving opening 115; (2) the lateral sides of the item receiving apparatus' door assembly 118; and/or (3) the lateral sides of the item receiving apparatus' item receiving bucket 121. In particular embodiments, a substantially vertical plane of symmetry of said item positioning assembly is substantially centered between: (1) the sides of the item receiving apparatus' item receiving opening 115; (2) the lateral sides of the item receiving apparatus' door assembly 118; and/or (3) the lateral sides of the item receiving apparatus' item receiving bucket 121.

Structure and Functionality of the Item Repositioning Assembly Actuation Mechanism As noted above, in various embodiments of the invention, as a result of the above structural arrangement, the overall arrangement of the first, second, third, and fourth item repositioning members 142, 144, 146, 148 may be changed by simply changing the vertical height of the third hinge 147. For example, the item repositioning assembly 140 may be moved from a first, "home" orientation shown in FIG. 1 to a second, "item redistribution" orientation shown in FIG. 2 by simply moving the third hinge 147 upwardly (e.g., along a substantially vertical axis).

In various embodiments of the invention, the item receiving apparatus 100 includes an item repositioning assembly actuation mechanism for selectively moving the third hinge 147 between a first, home orientation (e.g., in which the item repositioning assembly 140 is in the "home" orientation shown in FIG. 1) and a second, "item redistribution" orientation (e.g., in which the item repositioning assembly 140 is in the "item redistribution" orientation shown in FIG. 2). In particular embodiments, this actuation mechanism is configured to move the third hinge 147 between these first and second positions by moving the third hinge 147 along a substantially vertical path.

For example, in one embodiment of the invention, the item receiving apparatus 100 comprises a rod (not shown) that extends through the third hinge 147 (e.g., so that the rod and the third hinge are substantially coaxial). In various embodiments, a guide wheel is disposed adjacent an interior end of the rod (e.g., an end of the rod that is adjacent the item receiving apparatus' rear interior surface). In particular embodiments, the item receiving apparatus 100 further includes a substantially vertical guide track 160 disposed adjacent the item repositioning assembly's third hinge 147, and the guide wheel is positioned to roll vertically within the guide track 160. In various embodiments, the guide wheel is substantially enclosed within the guide track 160 so that the guide wheel can only move either: (1) upwardly within the guide track 160, or (2) downwardly within the guide track 160. This may serve to prevent the third hinge 147 from moving laterally relative to the item receiving apparatus' lateral sides and from moving toward or away from the item receiving apparatus' rear interior surface.

In this embodiment, the item receiving apparatus 100 may also include a cable 210 (see FIGS. 5A and 5B) that is attached, at its first end, adjacent (and preferably to) a bottom edge of the door assembly's item receiving bucket 121 (e.g., adjacent the edge of the item receiving bucket 121 that is positioned most deeply within the interior of the item receiving apparatus 100). In various embodiments, the cable 210 is attached, at its second end, adjacent (and preferably to), the item repositioning assembly's third hinge 147. In various embodiments, the cable 210 is tensioned so that when the door assembly 118 is moved from a closed to an open position, the first end of the cable 210 moves upwardly, which causes the cable's second end to exert an upward force on the item repositioning assembly's third hinge 147. This causes the third hinge 147 to move upwardly along the guide track 160, which moves the item repositioning assembly 140 from a first, "home" orientation (e.g., see FIG. 1) to a second, "item redistribution" orientation (e.g., see FIG. 2). In particular embodiments, the rod, guide wheel, and guide track 160 cooperate to maintain the third hinge 147 along a substantially vertical path as the item repositioning assembly 140 moves between the first, "home" orientation and the second, "item redistribution" orientation.

Similarly, in this embodiment, when the door assembly 118 is moved from an open to a closed position, the cable serves to lower the third hinge 147 substantially vertically adjacent the guide track 160 so that the item repositioning assembly 140 moves from the second, "item redistribution" orientation, back to the "home" orientation. Accordingly, in this embodiment of the invention, the item receiving apparatus 100 is adapted to move the item repositioning assembly 140: (1) from the first, "home" orientation to the second, "item redistribution" orientation in response to a user opening the door assembly 118; and (2) from the second, "item redistribution" orientation to the first, "home" orientation in response to a user closing the door assembly 118.

In other embodiments of the invention, the item receiving apparatus 100 may include a powered item repositioning assembly actuation mechanism 200 for selectively moving the item repositioning assembly 140 between the first, "home" orientation and the second, "item redistribution" orientation. For example, in the embodiment shown in FIGS. 6A and 6B, the item repositioning assembly actuation mechanism 200 includes a motorized rack and pinion assembly (e.g., including a rack 310 and a motorized pinion 320) that is adapted for selectively moving the third hinge 147 along a substantially vertical path of travel as described above, and to thereby move the item repositioning assembly 140 between the first "home" orientation and the second, "item redistribution" orientation.

In various embodiments, this motorized rack and pinion assembly is controlled by an appropriate control mechanism (e.g., a computerized control mechanism). This control mechanism may be adapted to move the item repositioning assembly 140 between the first, "home" orientation and the second, "item redistribution" orientation (and, optionally, back to the "home" orientation) in response to the occurrence of one or more predetermined events, such as: (1) the item receiving apparatus' door 120 being opened; (2) the item receiving apparatus' door 120 being closed; (3) the passage of a pre-determined amount of time (e.g., the control mechanism may be adapted to move the item repositioning assembly 140 between the first, "home" orientation and the second, "item redistribution" orientation and back again every 25 minutes); (4) the level of items stored within the interior storage area 110 exceeding a particular height (as sensed, for example, by a light sensor positioned within the interior storage area 100); (5) the weight of items stored within the interior storage area 110 exceeding a particular weight (as measured by a scale associated with the item receiving apparatus 100); (6) a user stepping on a pedal adjacent the item receiving apparatus 100; and/or (7) a user moving adjacent the item receiving apparatus 100 (as detected by a motion sensor associated with the item receiving apparatus 100). This may serve to cause the item repositioning assembly 140 to redistribute items within the item receiving apparatus 100 on a regular basis, which may, in turn, increase the item receiving apparatuses' storage capacity.

B. Operation of the Item Receiving Apparatus

To use the embodiment of the item receiving apparatus 100 shown in FIGS. 1-5, a user first opens the item receiving apparatus' door 120, which causes the door assembly 118 to rotate about a hinge 123 as shown in FIGS. 5A and 5B. This causes the item repositioning assembly 140 to move from the first, "home" orientation shown in FIG. 1, and into the second, "item redistribution" orientation shown in FIG. 2. The user then places items to be stored within the item receiving apparatus 100 into the door assembly's item receiving bucket 121. In various embodiments, if the user has several items, the user places some of the items adjacent a first lateral side of the door assembly's separator 124, and other items adjacent a second lateral side of the door assembly's separator 124. The user then closes the door assembly 118, which: (1) causes the item repositioning assembly 140 to move from the second, "item distribution" position and back into the first, "home" orientation; and (2) causes the items to slide out of the item receiving bucket 121 and to fall into the item receiving apparatus' interior storage area 110.

As demonstrated in FIGS. 3 and 4, as items are deposited into the item receiving apparatus, 100, the items may form piles adjacent one or both lateral sides of the item repositioning assembly 140. Once this occurs, the motion of the item repositioning assembly 140 between the first, "home" orientation and the second, "item redistribution" orientation serves to push the items within the piles toward the interior side edges of the interior storage area (and away from at least a portion of the item repositioning assembly 140). This process is demonstrated in FIG. 4 which shows two items "5" after they have been pushed toward the interior side edges of the interior storage area by the outer surfaces of the item repositioning assembly 140 as the item repositioning assembly 140 moved from the first, "home" orientation, and into the second, "item redistribution" orientation. This process is repeated over time which, in various embodiments, results in items being substantially uniformly distributed within the item receiving apparatus' interior storage area 110.

Various powered embodiments of the item receiving apparatus 100 may function in substantially the same manner as the embodiment described above, except that the motion of the item repositioning assembly 140 may be controlled by an automated control system as discussed above. In various embodiments, the control system may be adapted to: (1) cause the item repositioning assembly 140 to move into the "item redistribution" orientation in response to the item receiving apparatus' door being opened; and (2) maintain the item repositioning assembly 140 in the second, "item redistribution" orientation for a pre-determined period of time (e.g., for a period of time greater than 3, 5, or 7 seconds) after the item receiving apparatus' door 120 has been closed. This may serve to cause the first and second item repositioning members 142, 144 to laterally divert objects (e.g., toward the item receiving apparatus' lateral sides) as the items fall from the item receiving bucket 121 and into the interior storage area 110. In various embodiments, the first and second item repositioning members 142, 144 act as baffles to divert the items toward the lateral sides of the interior storage area 110.

In various embodiments of the invention, a lower portion of the item repositioning assembly 140 is adapted to push items that are disposed beneath the item repositioning assembly 140 laterally toward the sides of the item receiving apparatus 100 (and, preferably, laterally away from at least a portion of the item repositioning assembly 140) as the item repositioning assembly 140 moves from the second, "item redistribution" orientation to the first, "home" orientation. In various embodiments, this lower portion of the item repositioning assembly 140 includes the third and fourth item repositioning members 146, 148 and the third hinge 147.

More particularly, in various embodiments (e.g., the embodiment shown in FIGS. 1-4), the third and fourth item repositioning members 146, 148 are adapted so that they cooperate to form: (1) a relatively widely angled downwardly-directed V-shaped member when the item repositioning assembly 140 is in the second, "item redistribution" orientation; and (2) a relatively narrowly angled downwardly-directed V-shaped member when the item repositioning assembly 140 is in the first, "home" orientation. In particular, in various embodiments, the third and fourth item repositioning members 146, 148 are adapted so that they cooperate to form a downwardly-directed V-shaped member having a central angle of greater than 60, 70, 80, 90, and/or 100 degrees when the item repositioning assembly 140 is in the "item redistribution" orientation.

Similarly, in various embodiments, the third and fourth item repositioning members 146, 148 are adapted so that they cooperate to form a downwardly-facing V-shaped member having a central angle of less than 30, 25, and/or 10 degrees when the item repositioning assembly 140 is in the first, "home" orientation. As a result, in various embodiments, the leading point of the downwardly-directed V-shaped member may be adapted to wedge between various items in a pile of items (e.g., linen items) and, via a wedge effect, push items adjacent one or more lateral sides of the V-shaped member laterally toward the sides of the item receiving apparatus 100 (and, preferably, laterally away from at least a portion of the item repositioning assembly 140). In various embodiments, this occurs as the item repositioning assembly 140 moves from the second, "item redistribution" orientation to the first, "home" orientation. In various embodiments of the invention, the above wedge effect may serve to prevent a buildup of items below the item repositioning assembly 140 (e.g., below the item repositioning assembly's third hinge 147).

Materials

In various embodiments of the invention, the item receiving apparatus' housing and item repositioning assembly 140 are made of a suitable, preferably robust, material such as steel or heavy plastic. However, in other embodiments, the item receiving apparatus' various components may include any other suitable type of material.

Alternative Embodiments of the Invention

It should be understood that many alternative embodiments of the invention may have different structural components or different functional qualities than those described above. For example, while the various item repositioning members 142, 144, 146, 148 are described above as being substantially planar in various embodiments, in other embodiments, one or more of the item repositioning members 142, 144, 146, 148 may not be planar and may be of any other suitable shape. In addition, although the item repositioning assembly is described as having four item repositioning members in various embodiments described above, in other embodiments, the item repositioning assembly may include less or more than four item repositioning members, and may be in the form of any suitable shape (e.g., an upward or laterally facing V-shape).

Also, it should be understood that, while the item repositioning assembly according to various embodiments described above is adapted to push items toward the item receiving apparatus' lateral sides, in other embodiments, the item repositioning assembly may be adapted to push items within the item receiving apparatus 100 in other directions within the item receiving apparatus 100. For example, in certain embodiments, the item repositioning assembly may be adapted to push items within the item receiving apparatus 100 toward the interior front and/or rear surfaces of the item receiving apparatus. In a particular embodiment, the item repositioning assembly is adapted to substantially simultaneously: (1) push a first set of one or more items within the item receiving apparatus 100 toward the interior front surface of the item receiving apparatus; and (2) push a second set of one or more items within the item receiving apparatus 100 toward the interior rear surface of the item receiving apparatus.

In addition, it should be understood that an item repositioning assembly may be adapted to direct (e.g., push) items toward only one interior surface of the item receiving apparatus 100 rather than, for example, two surfaces. For example, the item repositioning assembly may be adapted to direct any items within the item receiving apparatus 100 toward a particular interior lateral, front, or rear side of the item receiving apparatus 100.

CONCLUSION

Many modifications and other embodiments of the invention will come to mind to one skilled in the art to which this invention pertains having the benefit of the teachings presented in the foregoing descriptions and the associated drawings. Accordingly, it should be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

We claim:

1. An item receiving apparatus comprising:

a housing defining: (A) an interior storage area; (B) an opening through which at least one item may be received for storage within said interior storage area;

an item support surface disposed adjacent said interior storage area for supporting one or more items as the items are stored within said interior storage area;

an item repositioning assembly disposed between said opening and said item support surface, wherein:

said item repositioning assembly comprises a first item repositioning member and a second item repositioning member;

said item receiving apparatus is adapted to move said item repositioning assembly from a first orientation to a second orientation, wherein said first item repositioning member and said second item repositioning member are configured to move in different directions as said item repositioning assembly moves from said first orientation to said second orientation; and said first item repositioning member and said second item repositioning member are adapted to push one or more items below said opening and within said storage area laterally away from at least a portion of said item repositioning assembly as said item repositioning assembly is moved from said first orientation to said second orientation.

2. The item receiving apparatus of claim 1, wherein at least a portion of said item repositioning assembly is disposed within said storage area.

3. The item receiving apparatus of claim 1, wherein said item repositioning assembly is disposed substantially entirely within said storage area.

4. The item receiving apparatus of claim 1, wherein said item repositioning assembly is adapted so that when said item repositioning assembly is in said second orientation, said item repositioning assembly serves to divert one or more objects as said one or more objects travel from said opening into said storage area.

5. The item receiving apparatus of claim 1, wherein said item repositioning assembly is adapted so that when said item repositioning assembly is in said second orientation, said item repositioning assembly serves to divert one or more objects as said one or more objects fall from said opening into said storage area.

6. The item receiving apparatus of claim 1, wherein said item repositioning assembly is adapted to, as said item repositioning assembly is moved from said first orientation to said second orientation:

(A) push a first set of one or more items that are disposed adjacent a first lateral side of said item repositioning assembly laterally relative to said item support surface; and (B) push a second set of one or more items that are disposed adjacent a second lateral side of said item repositioning assembly laterally relative to said item support surface.

7. The item receiving apparatus of claim 6, wherein said item repositioning assembly is adapted to, as said item repositioning assembly is moved from said first orientation to said second orientation:

push said first set of one or more items in a first direction; and push said second set of one or more items in a second direction, said second direction being substantially opposite to said first direction.

8. The item receiving apparatus of claim 1, wherein:

said first orientation is a home orientation;

said second orientation is an item redistribution orientation; and said item repositioning assembly is adapted so that said home orientation changes in response to said storage area becoming filled with objects.

9. The item receiving apparatus of claim 1, wherein:

said first item repositioning member is mounted to rotate about an axis as said item repositioning assembly is moved from said first orientation to said second orientation.

10. The item receiving apparatus of claim 9, wherein said second item repositioning member is mounted to rotate about an axis as said item repositioning assembly is moved from said first orientation to said second orientation.

11. The item receiving apparatus of claim 10, wherein said first item repositioning member and said second item repositioning member are mounted to rotate about a common axis as said item repositioning assembly is moved from said first orientation to said second orientation.

12. The item receiving apparatus of claim 11, wherein said first item repositioning member and said second item repositioning member are adapted to rotate in oppose directions about said common axis as said item repositioning assembly is moved from said first orientation to said second orientation.

13. The item receiving apparatus of claim 10, wherein said first item repositioning member and said second item repositioning member are adapted to rotate in oppose directions as said item repositioning assembly is moved from said first orientation to said second orientation.

14. The item receiving apparatus of claim 10, wherein said item repositioning assembly is adapted so that an upper side edge of said first item repositioning member is disposed adjacent an upper side edge of said second item repositioning member both when said item repositioning assembly is in said first orientation and when said item repositioning assembly is in said second orientation.

15. The item receiving apparatus of claim 10, wherein:

said item repositioning assembly is adapted so that:

(A) said first item repositioning member and said second item repositioning member cooperate to form a first angle when said item repositioning assembly is in said first orientation; and (B) said first item repositioning member and said second item repositioning member cooperate to form a second angle when said item repositioning assembly is in said second orientation; and said second angle is greater than said first angle.

16. The item receiving apparatus of claim 15, wherein, when said item repositioning assembly is in said second orientation, said first item repositioning member and said second item repositioning member are substantially symmetrically arranged in relation to a substantially vertical plane extending between at least a portion of said first item repositioning member and at least a portion of said second item repositioning member.

17. The item receiving apparatus of claim 1, wherein:

said first item repositioning member comprises:

a first elongated member having an upper side edge and a lower side edge;

said second item repositioning member comprises:

a second elongated member having an upper side edge and a lower side edge; and said upper side edge of said first elongated member is rotatably mounted adjacent said upper side edge of said second elongated member.

18. The item receiving apparatus of claim 17, wherein:

said item repositioning assembly further comprises a third elongated member having an upper side edge and a lower side edge; and said upper side edge of said third elongated member is rotatably mounted adjacent said lower side edge of said first elongated member.

19. The item receiving apparatus of claim 18, wherein:

said item repositioning assembly further comprises a fourth elongated member having an upper side edge and a lower side edge;

said upper side edge of said fourth elongated member is rotatably mounted adjacent said lower side edge of said second elongated member; and said lower side edge of said fourth elongated member is rotatably mounted adjacent said lower side edge of said third elongated member.

20. The item receiving apparatus of claim 19, wherein said first, second, third and fourth elongated members are each substantially planar.

21. The item receiving apparatus of claim 19, wherein said item repositioning assembly is adapted to be moved into a particular orientation in which said first, second, third, and fourth elongated members cooperate to form a structure having a substantially diamond shaped cross-section.

22. The item receiving apparatus of claim 21, wherein said item repositioning assembly is adapted to be moved into a particular orientation in which said first, second, third, and fourth elongated members cooperate to form a structure having a substantially triangular cross-section.

23. The item receiving apparatus of claim 19, wherein said lower side edge of said fourth elongated member is adapted to slide adjacent a guide track as said item repositioning assembly is moved from said first orientation into said second orientation.

24. The item receiving apparatus of claim 23, wherein said lower side edge of said third elongated member is adapted to slide adjacent said guide track as said item repositioning assembly is moved from said first orientation into said second orientation.

25. The item receiving apparatus of claim 1, wherein:

said item receiving apparatus further comprises:

a door disposed adjacent said opening, said door being positioned to selectively restrict access to an interior portion of said item receiving apparatus through said opening; and an item repositioning assembly actuation mechanism that is adapted to move said item repositioning assembly from said first orientation to said second orientation in response to said door being moved from a closed position to an open position.

26. The item receiving apparatus of claim 25, wherein said item repositioning assembly actuation mechanism comprises a cable member that extends between a portion of said door and a portion of said item repositioning assembly.

27. An item receiving apparatus comprising:

a housing defining: (A) an interior storage area, and (B) an opening through which at least one item may be received for storage within said interior storage area;

an item support surface disposed adjacent said interior storage area for supporting one or more items as the items are stored within said interior storage area; and an item repositioning assembly disposed between said opening and said item support surface, wherein said item receiving apparatus is adapted to move said item repositioning assembly from a first orientation to a second orientation, wherein:

as said item repositioning assembly moves from said first orientation to said second orientation, said item repositioning assembly expands laterally to reposition one or more items stored within said interior storage area.

28. The item receiving apparatus of claim 27, wherein:

said item repositioning assembly is adapted so that when said item repositioning assembly is in said second orientation, said item repositioning assembly serves to divert one or more objects as said one or more objects fall from said opening toward said item support surface.

29. The item receiving apparatus of claim 27, wherein said item repositioning assembly is adapted so that:

when said item repositioning assembly is in said first orientation, said item repositioning assembly is not positioned to divert one or more objects that are dropped through a particular portion of said opening as said one or more objects fall from said particular portion of said opening toward said item support surface; and when said item repositioning assembly is in said second orientation, said item repositioning assembly is positioned to divert one or more objects that are dropped through said particular portion of said opening as said one or more objects fall from said particular portion of said opening toward said item support surface.

30. The item receiving apparatus of claim 27, wherein said item repositioning assembly has a substantially triangular cross section when said item repositioning assembly is in said second orientation.

31. The item receiving apparatus of claim 27, wherein said item repositioning assembly has a substantially diamond-shaped cross section when said item repositioning assembly is in said second orientation.

32. The item receiving apparatus of claim 27, wherein:

said item repositioning assembly comprises a first item repositioning member and a second item repositioning member;

when said item repositioning assembly is in said first orientation, said first item repositioning member is in a first, first-item repositioning member angular orientation, and said second item repositioning member is in a first, second-item repositioning member angular orientation; and when said item repositioning assembly is in said second orientation, said first item repositioning member is in a second, first-item repositioning member angular orientation, and said second item repositioning member is in a second, second-item repositioning member angular orientation.

33. The item receiving apparatus of claim 32, wherein:

when said item repositioning assembly is in said second orientation, said first and second item repositioning members are substantially symmetrically arranged in relation to a substantially vertical plane extending between at least a portion of said first item repositioning member and at least a portion of said second item repositioning member.

34. The item receiving apparatus of claim 27, wherein said item repositioning assembly is adapted to, as said item repositioning assembly is moved from said first orientation to said second orientation:

(A) push a first set of one or more items that are disposed adjacent a first lateral side of said item repositioning assembly laterally relative to said item support surface; and (B) push a second set of one or more items that are disposed adjacent a second lateral side of said item repositioning assembly laterally relative to said item support surface.

35. The item receiving apparatus of claim 34, wherein said item repositioning assembly is adapted to, as said item repositioning assembly is moved from said first orientation to said second orientation:

push said first set of one or more items in a first direction; and push said second set of one or more items in a second direction, said second direction being substantially opposite to said first direction.

36. An item receiving apparatus comprising:

a housing defining: (A) an interior storage area, and (B) an opening through which at least one item may be received for storage within said interior storage area;

an item support surface disposed adjacent said interior storage area for supporting one or more items as the items are stored within said interior storage area; and an item repositioning assembly disposed between said opening and said item support surface, wherein said apparatus is adapted to move said item repositioning assembly from a first orientation to a second orientation, wherein:

as said item repositioning assembly moves from said first orientation to said second orientation, said item repositioning assembly expands laterally to at least partially obstruct a path between said opening and said item support surface.

37. The item receiving apparatus of claim 1, wherein said item receiving apparatus is adapted to move said item repositioning assembly from said first orientation to said second orientation in response to the occurrence of a pre-determined event.

38. The item receiving apparatus of claim 37, wherein said pre-determined event is an event indicating that one or more items will soon be deposited into said apparatus through said opening.

39. An item receiving apparatus comprising:

a housing defining: (A) an interior storage area; (B) an opening through which at least one item may be received for storage within said interior storage area;

an item support surface disposed adjacent said interior storage area for supporting one or more items as the items are stored within said interior storage area;

an actuation mechanism;

an item repositioning assembly disposed between said opening and said item support surface, wherein:

said actuation mechanism is adapted to move said item repositioning assembly from a first orientation to a second orientation; and said item repositioning assembly is adapted to push one or more items below said opening and within said storage area laterally away from at least a portion of said item repositioning assembly as said item repositioning assembly is moved from said first orientation to said second orientation.

40. The item receiving apparatus of claim 39, wherein said actuation mechanism comprises a powered actuation mechanism configured to automatically move said item repositioning assembly from said first orientation to said second orientation in response to the occurrence of a pre-determined event.

41. The item receiving apparatus of claim 39, wherein said actuation mechanism comprises a manually actuated mechanism operatively connected to said item repositioning assembly and configured to move said item repositioning assembly from said first orientation to said second orientation in response to manual input from a user.

42. The item receiving apparatus of claim 41, wherein:

said item receiving apparatus further comprises a door disposed adjacent said opening, said door being positioned to selectively restrict access to said interior storage area of said item receiving apparatus through said opening; and said actuation mechanism is configured to move said item repositioning assembly from said first orientation to said second orientation in response to said door being manually moved from a closed position to an open position.

* * * * *